United States Patent [19]

Kovacs

[11] Patent Number: 5,027,581

[45] Date of Patent: Jul. 2, 1991

[54] WRAPPING METHOD AND APPARATUS

[75] Inventor: Lloyd Kovacs, Sheboygan, Wis.

[73] Assignee: Hayssen Manufacturing Company, Sheboygan, Wis.

[21] Appl. No.: 530,741

[22] Filed: May 30, 1990

[51] Int. Cl.[5] ..... B65B 13/12

[52] U.S. Cl. ..... 53/399; 53/588

[58] Field of Search ..... 53/399, 441, 556, 588, 53/589, 587, 176

[56] References Cited

U.S. PATENT DOCUMENTS

| | | | |
|---|---|---|---|
| 3,003,297 | 10/1961 | Broadhead | 53/588 |
| 4,110,957 | 9/1978 | Lancaster | 53/589 |
| 4,204,377 | 5/1980 | Lancaster | 53/587 X |
| 4,282,700 | 8/1981 | Goldstein | 53/588 X |
| 4,317,322 | 3/1982 | Lancaster | 53/586 X |
| 4,432,185 | 2/1984 | Geisinger | 53/587 X |
| 4,483,124 | 11/1984 | Ohba | 53/588 X |
| 4,575,994 | 3/1986 | Takami | 53/589 X |
| 4,619,102 | 10/1986 | Geisinger | 53/587 X |
| 4,628,671 | 12/1986 | Storm et al. | 53/588 |
| 4,850,177 | 7/1989 | Laczkowski | 53/556 |

*Primary Examiner*—John Sipos

*Attorney, Agent, or Firm*—Senniger, Powers, Leavitt & Roedel

[57] ABSTRACT

A method of and apparatus for wrapping a strip of stretchable plastic cling film around work to be enwrapped (banded) wherein the leading end of the film is gripped at opposite sides by grippers, the grippers are disengaged from the strip and moved outwardly clear of the strip after one wrap has been completed and the strip has lapped itself for gripping itself to the work, and wherein the last wrap is held spaced away from the underlying portion of the strip for regripping of the strip, which is then cut to provide a finishing end and a new leading end of strip, the finishing end being secured to the underlying portion of the strip by being pressed against it for clinging thereto.

20 Claims, 17 Drawing Sheets

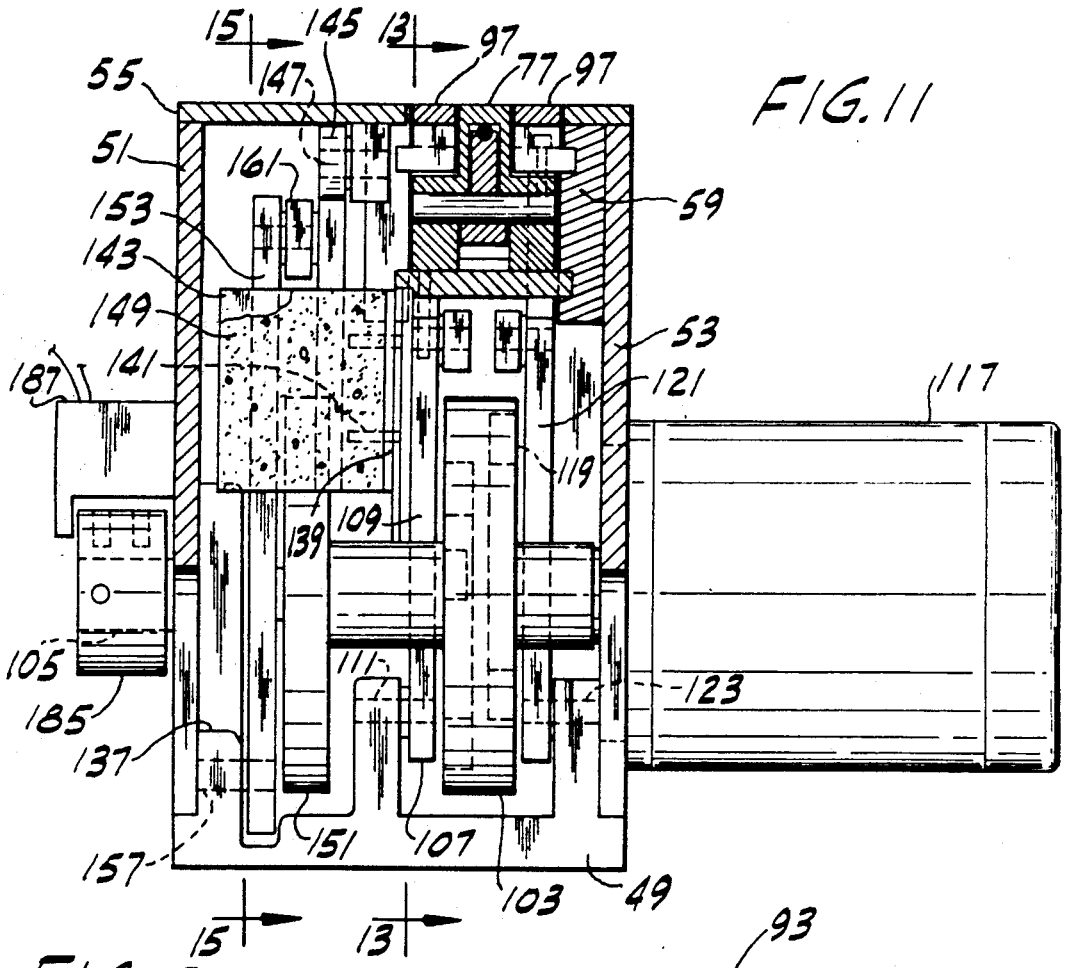
FIG. 11
FIG. 12
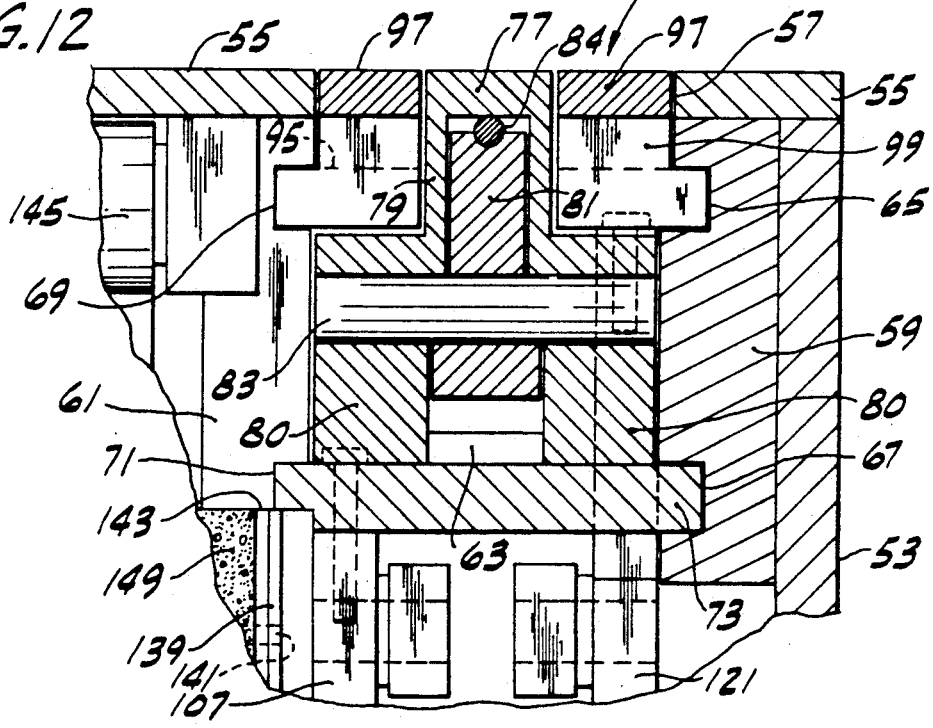

WRAPPING METHOD AND APPARATUS

BRIEF SUMMARY OF THE INVENTION

This invention relates to a method of and apparatus for wrapping flexible strip material, and more particularly a strip of stretchable plastic film around work to be enwrapped, as for strapping a carton, or bundling a plurality or set of items.

The invention may be regarded as an improvement upon the wrapping method and apparatus disclosed in U.S. Pat. No. 4,850,177, issued July 25, 1989, entitled Stretch Bundler, involving apparatus for wrapping work to be enwrapped (bundled) comprising a table or "load platform" for holding work to be enwrapped within a rotatable ring carrying a roll of relatively narrow flexible stretchable plastic film, the ring being rotatable to orbit the roll of film around the work for wrapping the film around the work. The apparatus disclosed in said patent includes a pair of grippers, each comprising an upper and a lower member for gripping the leading end of the film at its opposite edges to enable the wrapping. These grippers grip the film at opposite sides adjacent its leading end at the start of a wrapping operation, being subsequently moved out laterally to clear the way for the wrapping of a second convolution of the film on the first, and the wrapping of additional convolutions one on another, if desired. The grippers remain closed as they move out, stretching the film laterally, and are subsequently opened. Before completion of the last wrap, the upper members of the grippers are moved back in, and the last wrap comes under them, after which the lower members of the grippers are moved in, closed to grip the film, and the latter is cut.

While the method and apparatus disclosed in said U.S. Pat. No. 4,850,177 may be generally satisfactory in many respects, the bundle formed thereby may encounter objection in certain instances because, with the grippers remaining closed on the film gripping it at opposite sides as they move out, tails or ears such as may be observed in FIGS. 5 and 6 of said patent and which are indicated at 24 in FIG. 6 are formed, these tails or ears remain in the completed bundle, and may be viewed as unsightly.

Accordingly, among the several objects of the invention may be noted the provision of improved apparatus of the general type shown in said U.S. Pat. No. 4,850,177 having an improved method of operation for accomplishing tight wrapping or bundling of work without formation of tails or ears as occurs in the operation of the apparatus shown in said patent; the provision of such an apparatus and such a method for simple and efficient enwrapping of various work to be enwrapped, e.g. cartons, sets of items, plural pieces, rolled-up carpet, etc.; the provision of such apparatus which is readily adapted for applying two or more wraps around the work; and the provision of such apparatus which is operable electromechanically without pneumatics as required by the apparatus shown in said Patent.

In general, the method of this invention involves the wrapping of a strip of wrapping material around work to be enwrapped with the work held in position for having the strip wrapped around it in a predetermined plane. The strip is supplied from a roll thereof with the roll movable around the work for wrapping it. The strip is gripped at opposite sides thereof adjacent its leading end for starting the wrapping of the work by a pair of grippers which are movable in and out transversely with respect to the strip between an inner position for gripping the strip at opposite sides thereof and an outer retracted position spaced a distance greater than the width of the strip. The roll is moved around the work for wrapping a plurality of convolutions of the strip around the work. The grippers are opened for disengagement from the strip and moved to their outer position after the first convolutions has been wrapped around the work and the strip has lapped itself for gripping itself to the work for continuing the wrapping with the grippers disengaged from the work and moved to their outer position. The terminal portion of the last convolutions of the strip is held spaced away from the underlying portion of the strip to enable the opened grippers to move in to their inner position, and the opened grippers are moved in to their inner position and closed to grip the strip at opposite sides thereof. Then the strip is cut to provide a finishing end for the wrapping being completed and a new leading end for the wrapping being the grippers, for starting the next wrapping operation, and the finishing end is secured to the underlying portion of the strip to complete the wrap.

In general, apparatus of this invention comprises means for holding the work in position for having the strip wrapped around it in a predetermined plane, means for holding a roll of the strip for movement of the roll around the work for wrapping it, a pair of grippers for gripping the strip at opposite sides thereof adjacent its leading end for starting the wrapping of the work, and means mounting the grippers for movement in and out transversely with respect to the strip between an inner position for gripping the strip at opposite sides thereof and an outer retracted position spaced a distance greater than the width of the strip. The grippers are constructed and arranged for closing to grip the strip and opening for release from the strip. Means is provided for moving the roll holding means around the work for wrapping a plurality of convolutions of the strip around the work. Means controls the grippers to move them inwardly while open to their inner position, to close them to grip the strip at opposite sides thereof, and to maintain their grip on the film while the first convolution of the strip is being wrapped around the work and until it has lapped itself for gripping itself to the work, then opening the grippers and moving them out to their outer retracted position. Means is movable into position before completion of the wrapping of the last convolution of the strip for holding the terminal portion of the last convolution away from the underlying portion of the strip to enable the inward movement of the grippers for gripping the terminal portion of the last convolution of the strip at opposite sides thereof. And means is provided for cutting the strip to provide a finishing end for the wrapping being completed and a new leading end of the strip, gripped by the grippers, for starting the next wrapping operation, and for securing the finishing end of the wrapping to the underlying portion of the strip to complete the wrap.

Other objects and features will be in part apparent and in part pointed out hereinafter.

BRIEF DESCRIPTION OF THE DRAWINGS

FIG. 11 is an end view, with parts broken away and shown in section, of a unit of the apparatus including grippers, spacer fingers, a knife for cutting the film and a film presser pad;

FIG. 12 is an enlarged fragment of FIG. 11;

Corresponding reference characters indicate corresponding parts throughout several views of the drawings.

DETAILED DESCRIPTION

Figure 1:
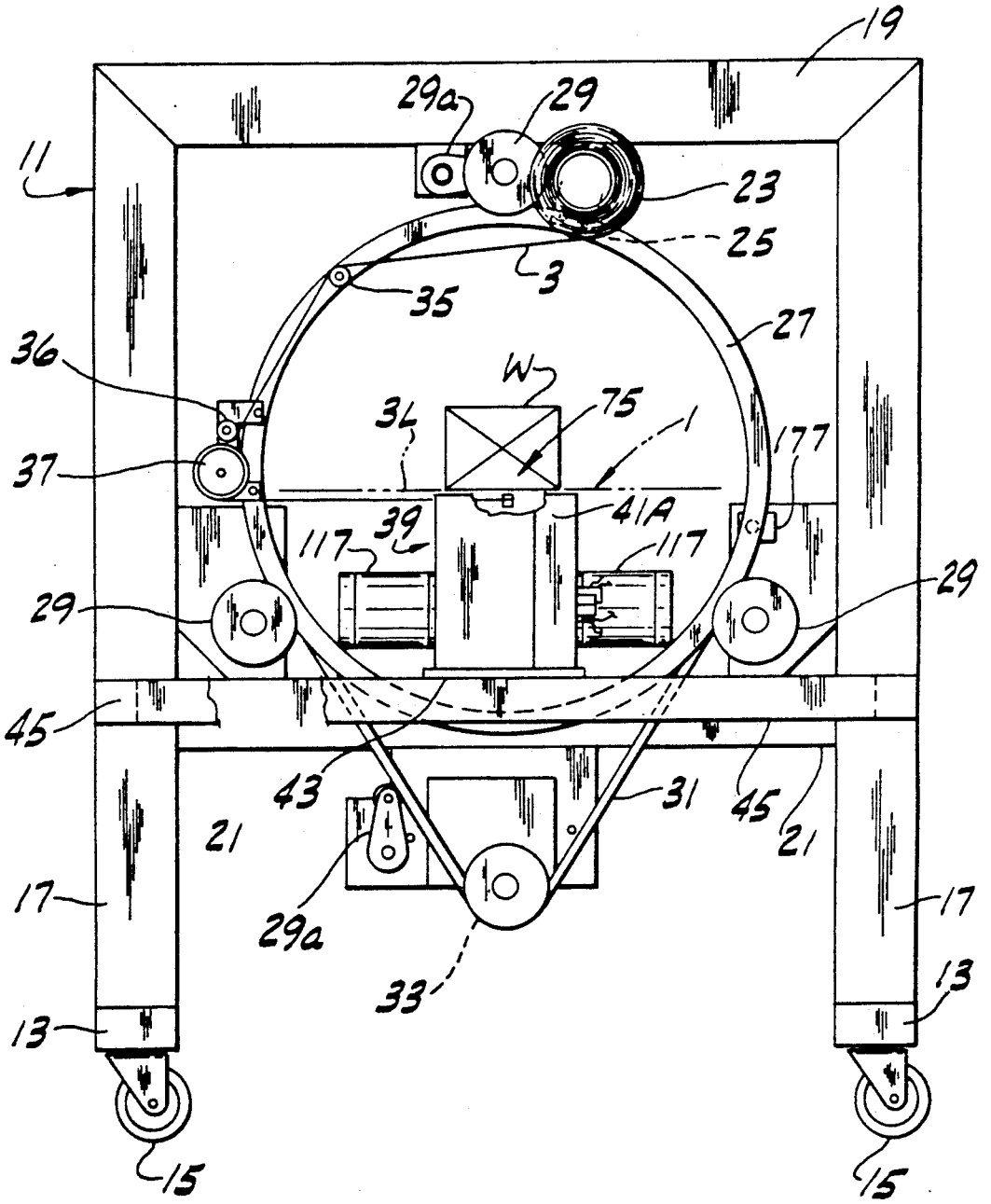
FIG. 1 is a view in front elevation of an apparatus of this invention with cabinetry removed, and showing a ring of the apparatus carrying a roll of film in what may be referred to as its home position for starting a wrapping cycle.
Figure 2:
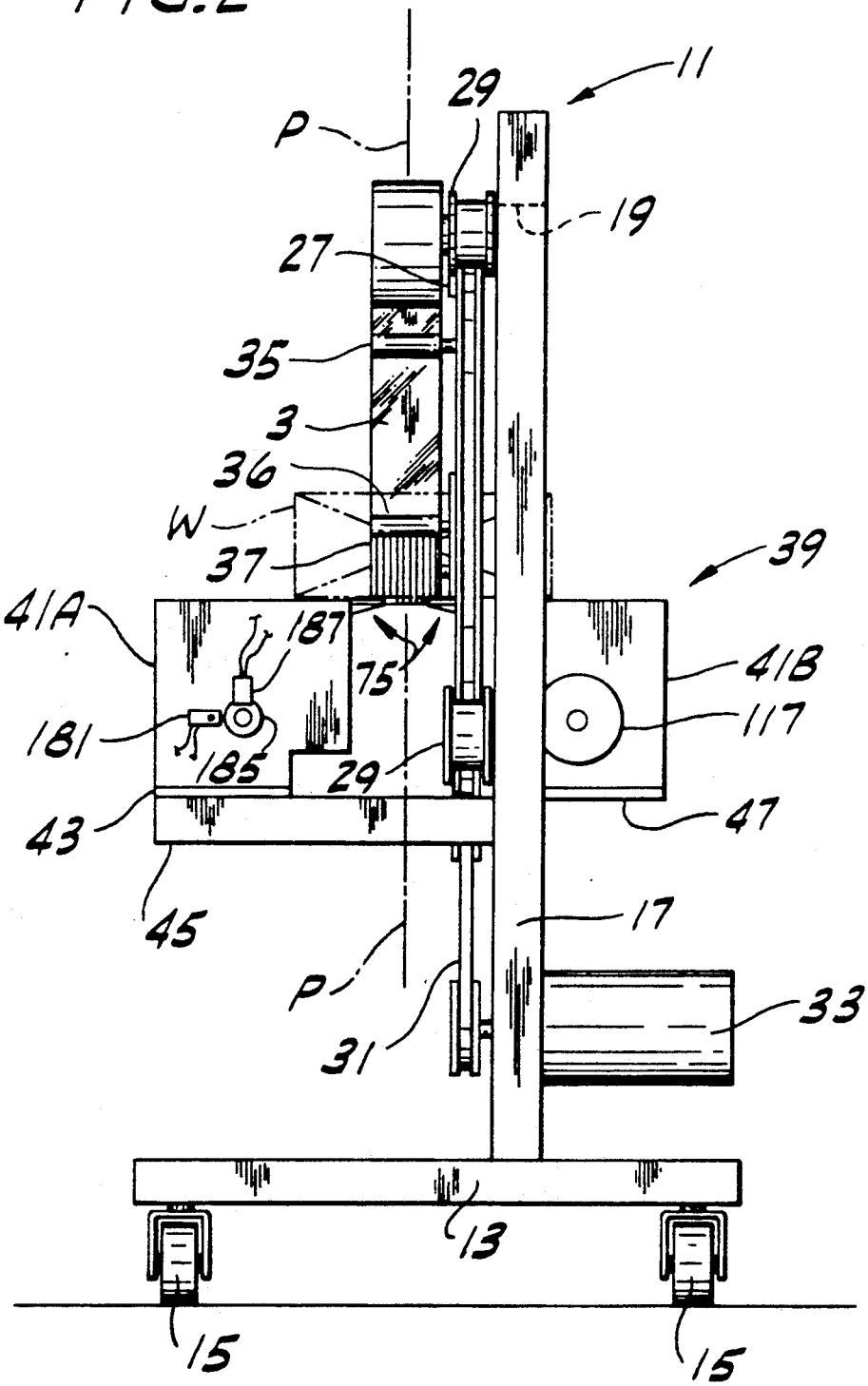
FIG. 2 is a side elevation of FIG. 1.
Figure 3:
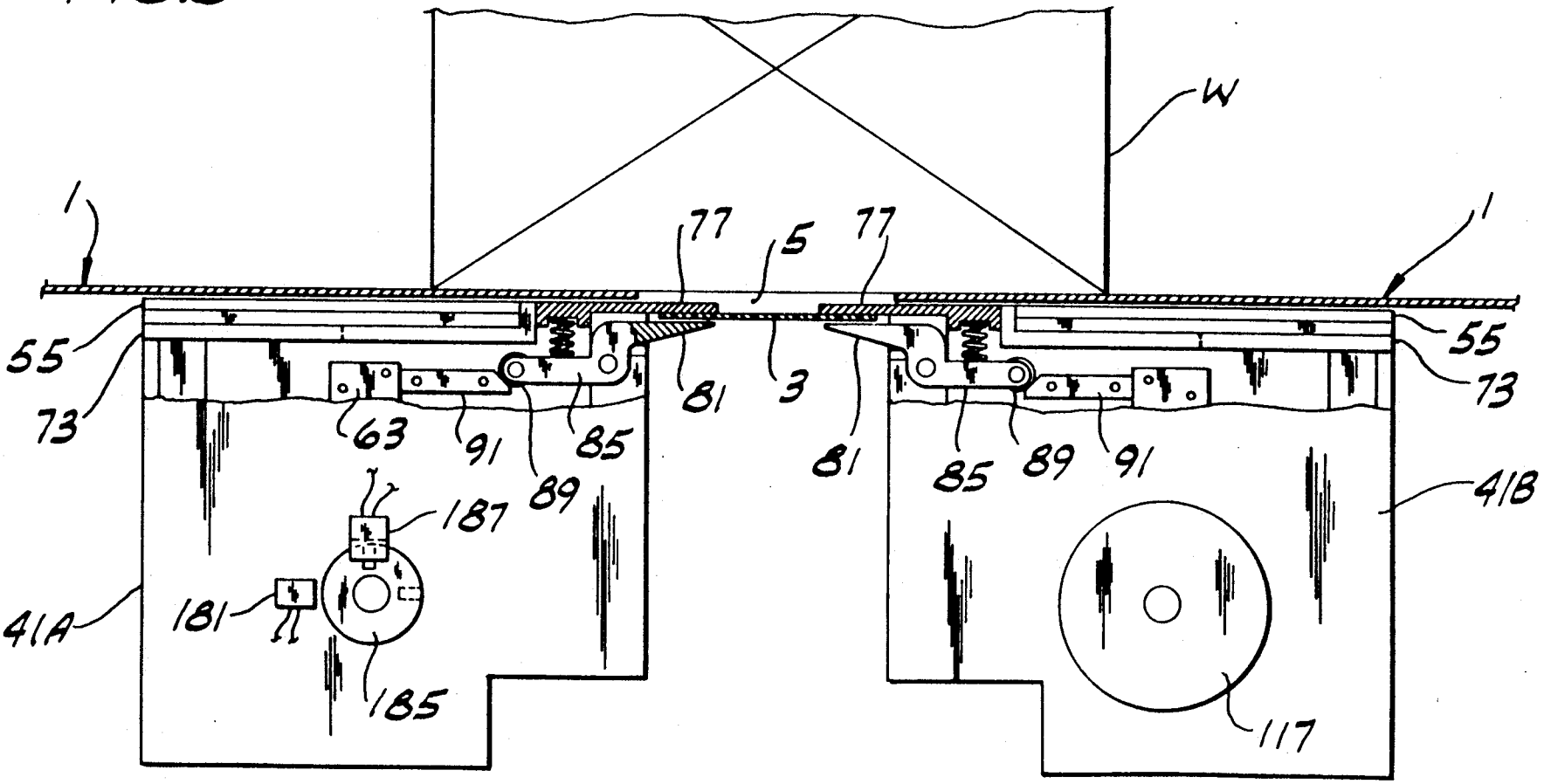
FIG. 3 is an enlarged fragment of FIG. 2 with parts broken away and shown in section, and showing grippers of the apparatus in their inner (extended) position gripping the film at opposite sides thereof adjacent its leading end for starting a wrapping cycle.

Referring to the drawings, wrapping apparatus of this invention is shown to comprise means indicated generally at 1 for holding work designated W in position for having strip material 3, e.g. flexible stretchable sheet plastic strip material such as a strip of polyethylene film three inches wide, wrapped around it with the wrapping taking place in a predetermined vertical plane indicated at P in FIG. 2. As herein illustrated, the work W is a carton which is rectangular in transverse section and which is wrapped or strapped with the film as will hereinafter appear, the wrapping being a spiral wrapping in said predetermined vertical plane transverse to the carton. The work-holding means 1 comprises a work-supporting platform or table having a slot 5 therein, the work being positioned for being wrapped on the table extending across the slot as shown in FIGS. 2 and 3. The table 1 is supported by a frame designated in its entirety by the reference numeral 11 comprising a pair of pedestals each designated 13 on casters 15, uprights 17 extending up from the pedestals, a crossbar 19 extending between the upper ends of the uprights, and an intermediate crossbar 21 extending between the uprights somewhat below midheight of the uprights. The table constitutes part of suitable cabinet structure which is omitted in FIGS. 1 and 2 to show interior detail. It appears in FIG. 9.

The strip material or film 3 for wrapping the work is supplied from a roll 23 of the film mounted on a roll holder 25 carried by a ring 27 rotatable in a vertical plane offset to one side of the wrapping plane P. Generally, a cling film is used, and preferably one that has high cling inside, low cling outside. The ring 27 is peripherally mounted for rotation in its plane by means of grooved ring-mounting rollers 29 mounted on the frame 11, the ring tracking in the grooves of the rollers 29, and itself being grooved for reception of a drive belt 31 for driving it to rotate clockwise as viewed in FIG. 1 by means of a drive including an electric motor 33 (see FIGS. 2 and 20), more particularly a stepper motor. At 29*a* is indicated a belt-tensioning roller. The ring carries a guide roller 35, a wrap roller 36 and a tension roller 37, film unwinding from the roll 23 being trained over the guide roller 35 and thence around the wrap roller 36 and the tension roller 37 and traveling from the latter to the work. The arrangement is such that the work may be placed on the table in position to be wrapped within the ring as shown in FIGS. 1 and 2, the roll 23 and rollers 35, 36 and 37 being movable with the ring around the work generally in the vertical plane P for wrapping film delivered from the roll 23 and stretched by passage over the tension roller 37 around the work. The ring is of relatively large diameter such as to accommodate therewithin work of the largest size (in the vertical plane in which it is wrapped), and the slot 5 is sufficiently wide to accommodate film of the maximum width to be used for wrapping.

Figure 13:
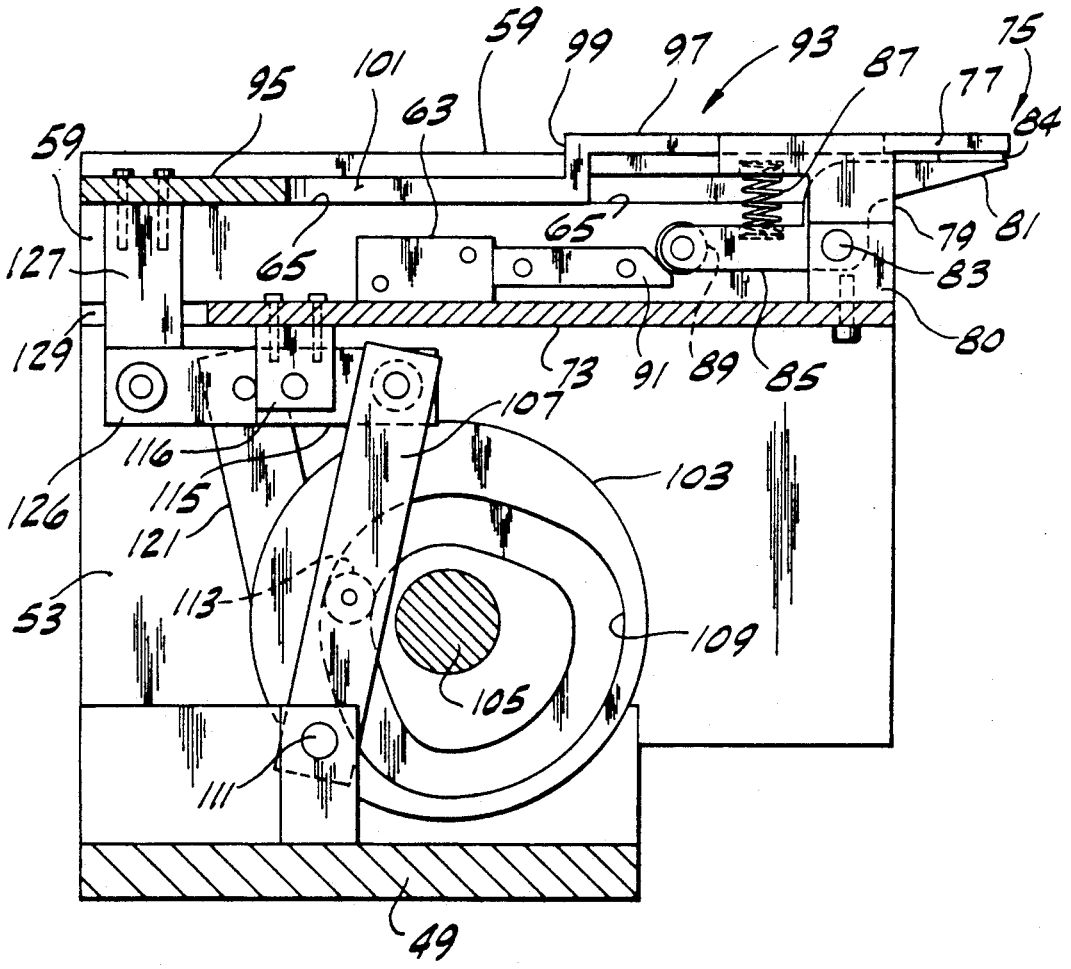
FIG. 13 is a vertical longitudinal section of the unit shown in FIG. 11 generally on line 13—13 of FIG. 11, showing the gripper of the unit in extended position and the spacer fingers of the unit in retracted position.
Figure 14:
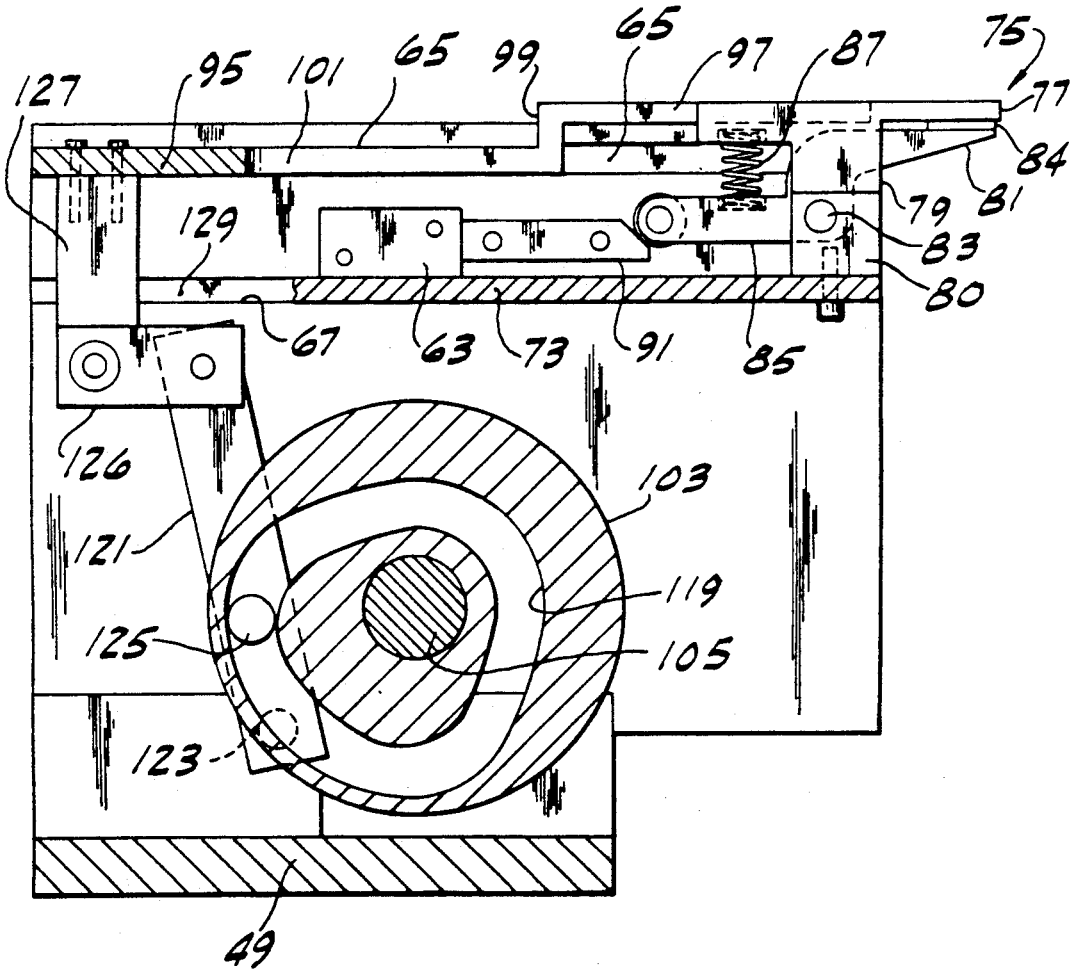
FIG. 14 is a view similar to FIG. 13 with parts broken away and shown in section.
Figure 15:
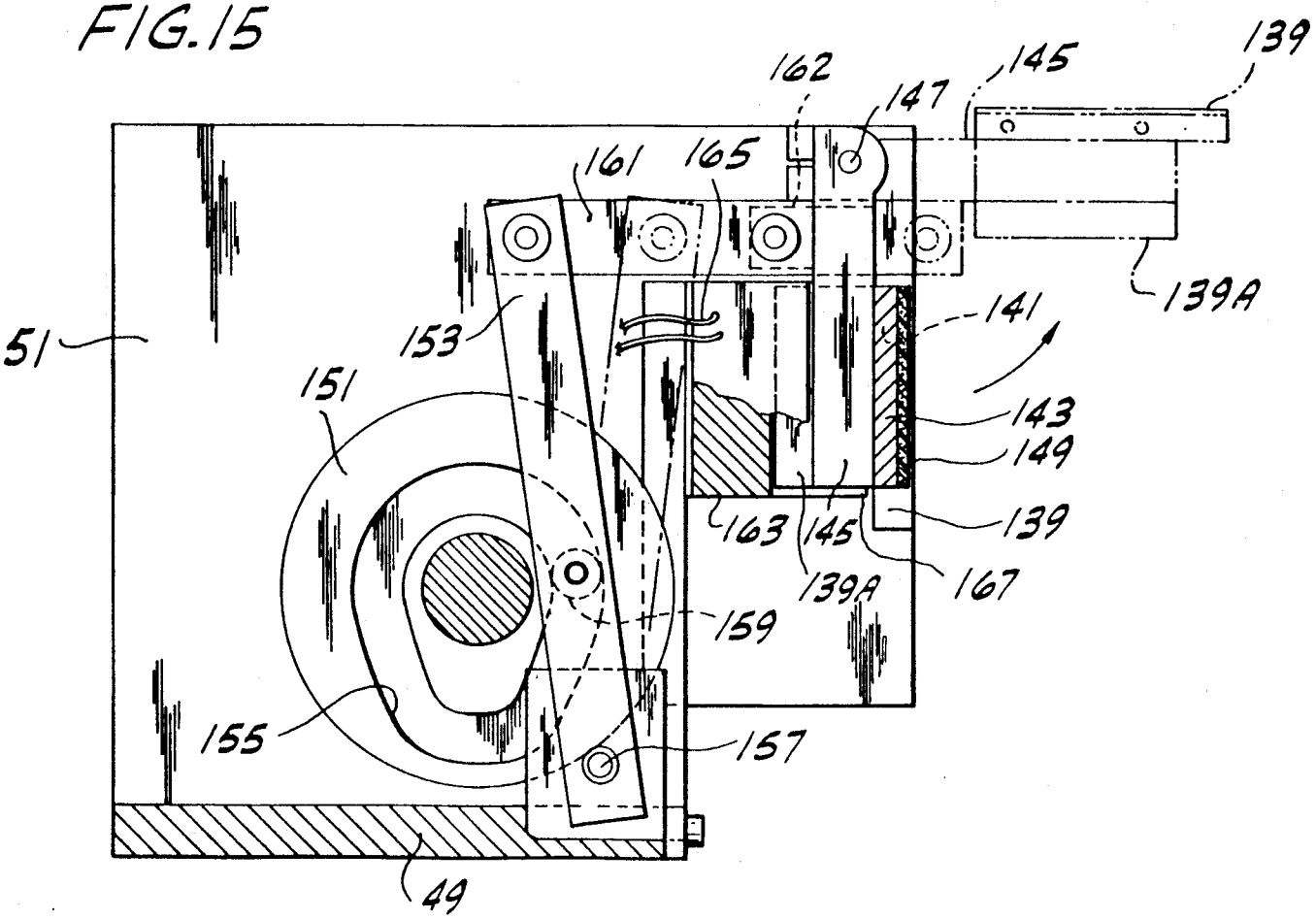
FIG. 15 is a view in section generally on line 15—15 of FIG. 11 showing the knife and pad mechanism.
Figure 18:
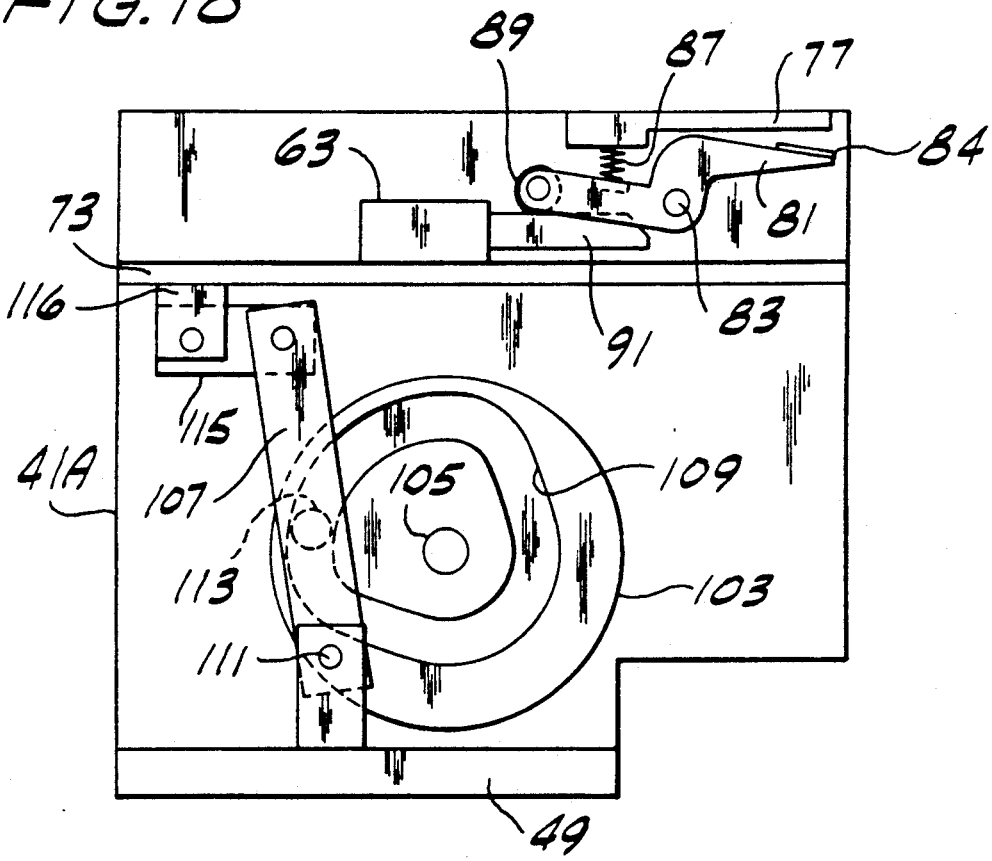
FIG. 18 is a view similar to FIG. 13 showing the grippers open and retracted.

At 39 is generally indicated improved means of this invention for gripping the film to start the wrapping of the work W and for cutting the film at the termination of a wrapping cYcle and securing the last convolution (which may be the second, third, fourth etc. convolution) in place. This means comprises two so-called actuator assemblies or gripper units mounted just below the table 1 at opposite sides of the slot 5 therein, each of these units being generally designated 41, with the unit which is toward the left as viewed in FIG. 2, referred to as the front of the apparatus (and which is where the operator stands to place work to be wrapPed on the table and to remove the wrapped work) being designated 41A and the other 41B. The front unit 41A is mounted on a plate 43 secured to a bracket structure 45 carried by the frame uprights 17 and the rear unit 41B is mounted on a plate 47 secured on the intermediate crossbar of the frame. Referring more particularly to FIGS. 11–15 the front unit 41A is shown to comprise a base 49 which is mounted on the respective plate 43, side walls 51 and 53 extending up from the base at opposite sides thereof and a top 55 having a notch 57 (see FIGS. 9 and 10) at one end thereof which may be referred to as its forward end. Guide rails 59 and 61 extend parallel to one another longitudinally of the unit immediately below the top 55 spaced apart transversely of the unit, the rail 59 being secured to the side wall 53 and the rail 61 being secured by means of a cross-block 63 to the rail 59. Rail 59 has an upper guide groove 65 and a lower guide groove 67 extending lengthwise thereof, and rail 61 has an upper guide groove 69 oPposite groove 65 and a lower groove 71 opposite groove 67. Slidable longitudinally of the unit in the lower grooves 67 and 71 is a gripper carriage plate 73 carrying a gripper generally designated 75 comprising a fixed upper jaw 77 on a stem 79 on side supports 80 secured on plate 73 adjacent its forward end, and a movable lower jaw 81 pivoted as indicated at 83 between the side supports 80 for up and down swinging movement toward and away from the fixed upper jaw. The lower jaw has a resilient insert 84 and a rearwardly extending arm 85 based downwardly by a spring 87 to swing the lower jaw up to its closed position for resiliently gripping the respective edge of the film up against the fixed upper jaw 77. Arm 85 has a cam follower 89 at its rearward end engageable with a cam 91 fixed on the side rail 59 as the carriage plate 73 is moved rearward from the forward or extended position in which it is illustrated in FIGS. 13 and 14 to the rearward retracted position in which it is illustrated in FIG. 18 for swinging the lower jaw down to its open position against the spring bias. The fixed upper jaw 77 is narrower than the carriage plate 73.

At 93 is generally indicated film spacer means, the function of which will be subsequently described, comprising a slide plate 95 slidable horizontally in the upper grooves 65 and 69 in the rails 59 and 61 and a pair of spacer fingers each designated 97 extending forward from the forward end of the plate 95 at a level above the plate 95 at opposite sides of the fixed gripper jaw 77 and at the level of the latter. The fingers extend forward from the upper ends of risers 99 extending up from the forward end of the plate 95. The jaw 77 extends lengthwise in the slot 101 between the fingers (see FIGS. 9 and 10), this slot continuing on back between the risers 99 and into the slide plate 95 for receiving the stem 79 which carries the upper jaw. The fingers 99 extend on opposite sides of the jaw 77 in the notch 57 in the top 55 of the unit, the fingers and jaw being flush with one another and flush with the top.

Figure 9:
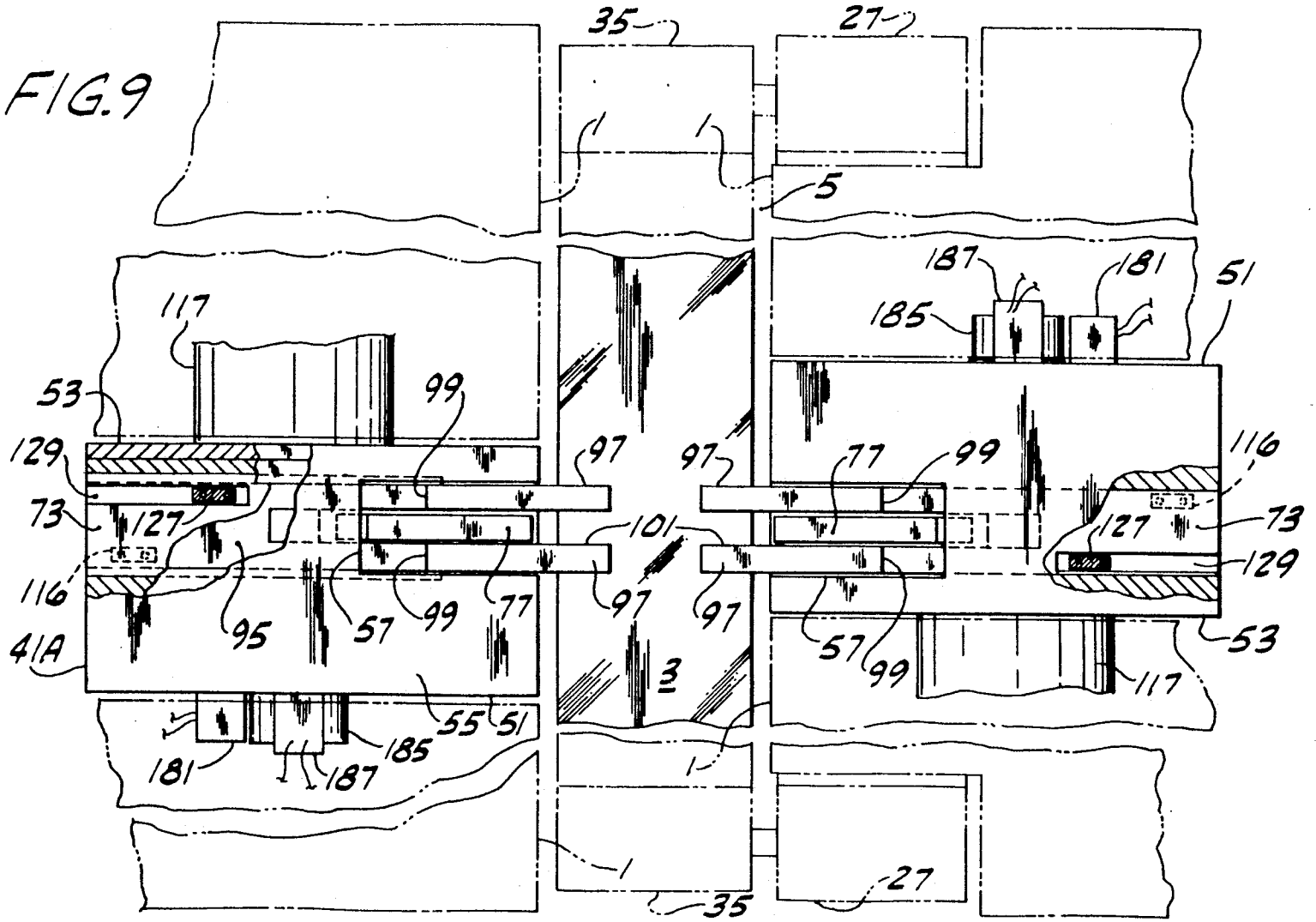
FIG. 9 is a plan showing the grippers and spacer fingers with the former retracted and the latter extended as in FIG. 7.
Figure 10:
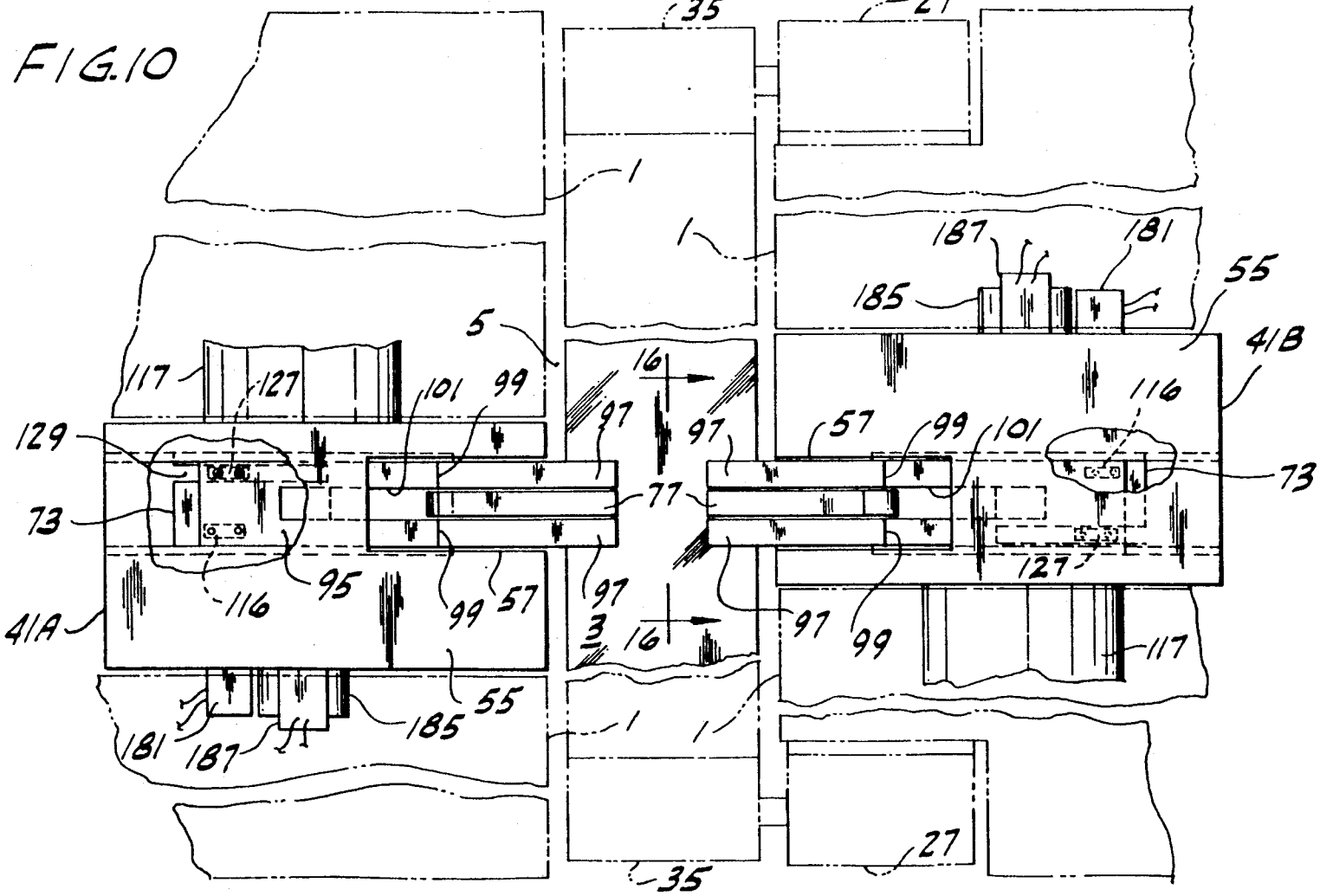
FIG. 10 is a view similar to FIG. 9 showing both the fingers and grippers extended, the grippers gripping the film.
Figure 19:
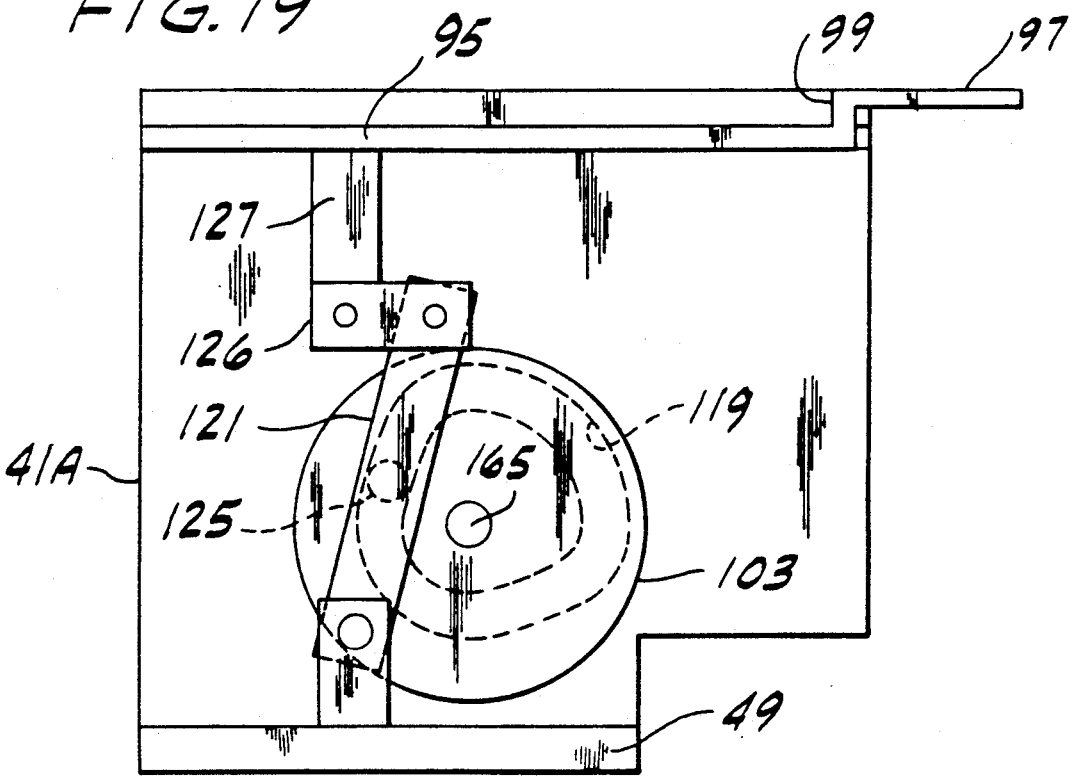
FIG. 19 is a view similar to FIG. 13 showing the spacer fingers extended.

The gripper carriage plate 73 carrying the gripper 75 (fixed jaw 77 and movable jaw 79) is movable forward and rearward (in and out) between the forward position (which may also be referred to as its inner or extended position) in which it is illustrated in FIGS. 10, 13 and 14 wherein the gripper 75 is located to grip the film 3 at one side (the front side for unit 41A) and a rearward position (which may also be referred to as its outer or retracted position) in which it is illustrated in FIGS. 9 and 18 wherein the gripper 75 is clear of the film, by mechanism comprising a rotary cam 103 on a camshaft 105 and a cam follower lever 107. The cam 103 has a cam groove 109 in one face thereof. Lever 107 is pivoted on the base of the unit as indicated at 111, has a follower 113 in the groove 109, and is connected by a link 115 to a lug 116 extending down from the gripper carriage plate 73. At 117 is indicated a motor for driving the camshaft. The spacer finger slide plate 95 is movable forward and rearward (in and out) between the forward position (which may also be referred to as its inner or extended position) in which it is illustrated in FIGS. 9, 10 and 19 wherein the fingers 97 extend past the vertical plane of the respective side edge of the film (the front side edge for unit 41A) and a rearward position (which may also be referred to as its outer or retracted position) in which it is illustrated in FIGS. 13 and 14, wherein the fingers are clear of the film, by means of a cam groove 119 in the other face of the cam 103 and a second follower lever 121. The latter is pivoted on the base as indicated at 123, has a follower 125 in the groove 119, and is connected by a link 126 to a member 127 extending down from the slide plate 95 through a slot 129 in plate 73.

The motor 117 is mounted on the side wall 53 of the unit, the camshaft extending from the output shaft of the motor across the unit from side wall 53 to and through side wall 51 and being journaled in a bearing at 137 on the inside of side wall 51. The cam 103 is secured on the cam shaft 105 inside side wall 53. Cam groove 109 is in the face of the cam away from side wall 53; cam groove 119 is in its opposite face toward side wall 53. Follower lever 107 is on the side of the cam 103 away from side wall 53; follower lever 121 is on the opposite side of the cam toward side wall 53. At 139 (see FIGS. 15–17) is indicated a knife for cutting the film, this knife being constituted by a thin blade secured flatwise on one edge as indicated at 141 of a plate 143 mounted at the free end of a lever 145 pivoted at 147 on the inside of side wall 51 for swinging movement on an axis parallel to the axis of the camshaft 105 from the retracted position wherein the lever extends down from the pivot 147 in which it is shown in solid lines in FIG. 15 upward to the raised position shown in dotted lines in FIG. 15 wherein the lever extends generally horizontally from the pivot. Plate 143 carries a pad 149 as well as the knife on the face of the plate which is uppermost as the plate swings up with the lever. The lever is swingable up and down by mechanism comprising a cam 151 on the camshaft 105 and a follower lever 153. The cam 151 has a cam groove 155 in its face toward the side plate 51. Lever 153 is pivoted at 157 on the base, has a follower 159 in the groove 155, and is connected by a link 161 to an arm 162 on the lever 145. The cam groove is so developed and phased and the mechanism is such that with the cam in its home Position of FIG. 15, the lever 145 is down in its retracted position, stays down as the cam 151 rotates through 180°, and is then swung up for cutting of the film by the knife blade and pressing of the film by the pad 149 as will appear, and then swung back down to its retracted position in the succeeding 180° of rotation of the cam. The knife blade swings up and down in a vertical plane transverse to the film and closely adjacent the outside of that spacer finger, specially designated 97A in FIGS. 16 and 17 which is downstream from the grip-Per 75 along the length of film extending from the roller 37. The pad presses the end of the film indicated at 3F in FIG. 17 against the underlying wrap for securement of the cut end to the underlying wrap by clinging of the cut end to the underlying wrap. The knife blade is heated by means such as indicated at 163 in FIG. 15 comprising a block having an electrical resistance heater (not shown) incorporated therein, wiring for the heater being indicated at 165. The block has a slot 167 receiving the knife blade extension indicated at 139A when the blade swings down to its lowered retracted position.

The unit 41B is identical to the unit 41A except that the cam 151, lever 153, link 155, lever 145, plate 143 and the knife 139 and pad 149 are omitted, unit 41A being solely responsible for the operation of cutting the film and securing the cut end of the film in place. The grippers 75 of the two units are movable in and out transversely with respect to the film between their inner position for gripping the strip at opposite sides thereof and their outer retracted position wherein they are spaced a distance greater than the width of the film.

Figure 20:
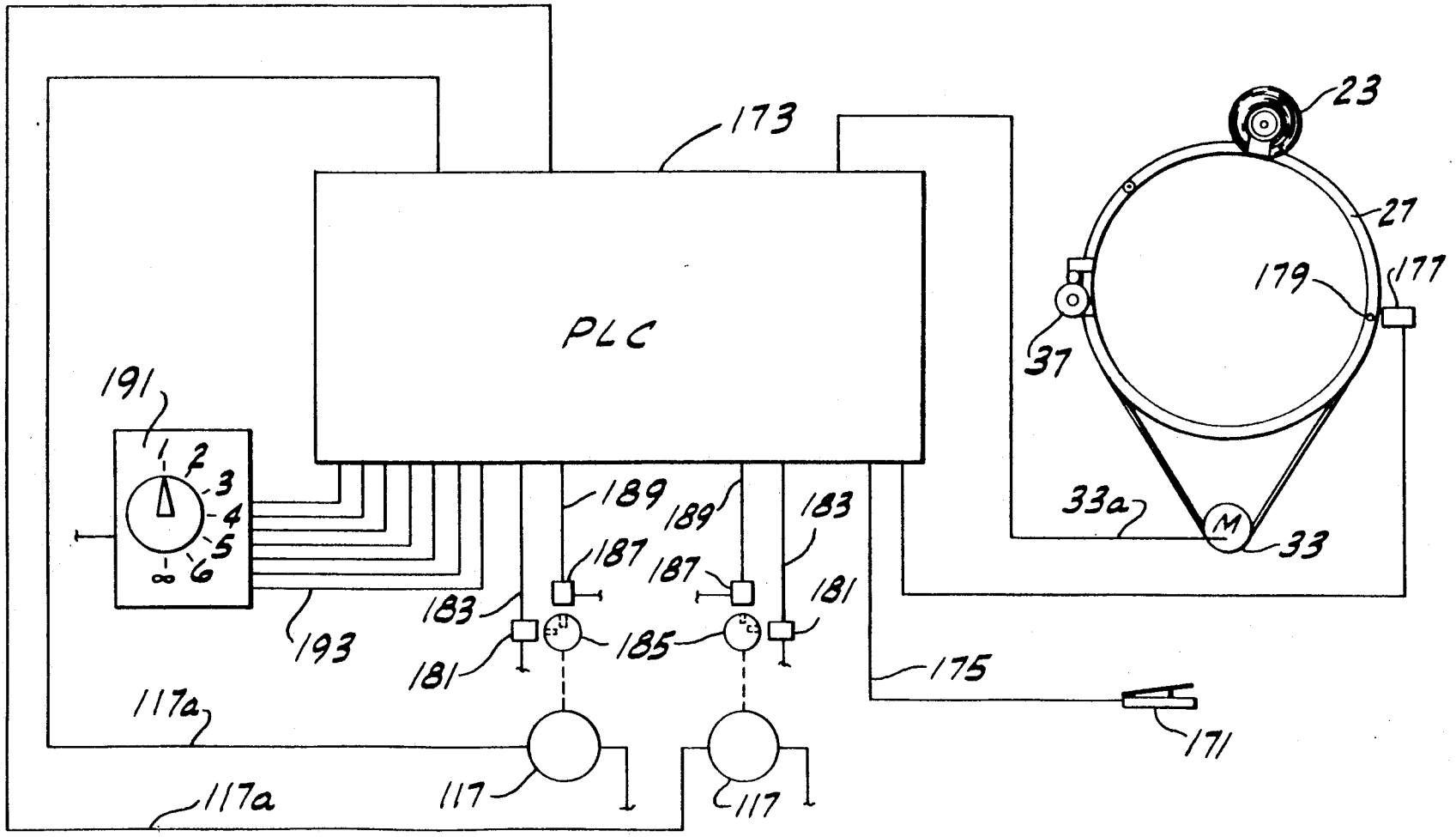
FIG. 20 is an electrical diagram.

Referring to FIG. 20, there is indicated at 171 a foot switch for starting a cycle of operation of the apparatus under control of a programmable logic controller 173 such as an Omron C-28K controller sold by Omron Company of Japan, this foot switch being connected to the controller as indicated at 175. At 177 is indicated a proximity switch (e.g. a sensor switch) for sensing the position of the ring 27 in conjunction with a switch actuator or "flag" 179 on the ring, more particularly for sensing the position of the roll of film 23 and the tension roller 37 on the ring, and signalling the controller 173 as to the position of the ring for controlling the stepper motor 33 which drives the ring to cut off at the point for stopping the ring in the home position in which it is illustrated in FIGS. 1 and 20 wherein the roll of film is approximately at the one o'clock position and the tension roller 37 is approximately at the nine o'clock position with film extending generally horizontally from the tension roller to the work just below the level of the table 1. The interconnection of the motor 33 and the controller 173 is indicated at 33*a*. On the side wall 51 of each of the units 41A and 41B adjacent the end of the camshaft 105 which extends out of this wall is a proximity switch 181 (e.g. a sensor switch) each interconnected with the controller 173 as indicated at 183 each operated by a switch actuator 185 on the end of the respective camshaft for signalling the controller that the cams are in home position, i.e. the position of the cams illustrated in FIGS. 13 and 14. Also on side wall 51 of each of the units 41A and 41B adjacent the stated end of the camshaft is a proximity switch 187 interconnected with the controller 173 as indicated at 189 each operated by the switch actuator 185 for signalling the controller what position the grippers 75 and spacer fingers 97 should be in so that they are extended and retracted at the proper time in the cycle. The interconnection between each motor 117 and the controller 173 is indicated at 117A.

With regard to the extension and retraction of the grippers and fingers, the mechanism is such that with cam 103 in its home position (see FIG. 13), the respective gripper 75 is extended (i.e. in its inner position for gripping the film at the respective edge thereof), and the respective spacer fingers 97 are retracted, i.e. in their outer position clear of the film. The cam groove 109 of each cam 103 is so developed and phased that the respective gripper 75 is moved out to its retracted position during the initial 90° of rotation of the cam, dwells in its retracted position during the next 90° of rotation of the cam, and returns to its extended (inner) position during the final 180° of rotation of the cam. The cam groove 119 is so developed and phased that the fingers 97 dwell in their retracted position for the initial 90° of rotation of the cam 103, are moved in to their extended (inner) position (see FIGS. 9, 10 and 19) during the next 90° of rotation of the cam, and return to their retracted position during the final 180° of rotation of the cam. The cam groove 155 in cam 151 is so developed and phased that the knife 139 stays down in its retracted position (as shown in solid lines in FIG. 15) during the first and second 90° of rotation of the cam, and is swung up for cutting the film and then swung back down to its retracted position during the final 180° of revolution of the cam.

At 191 is indicated a wrap selector switch connected as indicated at 193 with the controller 173. This switch is adapted to be set for controlling the apparatus to operate through a 2-wrap, 3-wrap, 4-wrap, 5-wrap or 6-wrap cycle on momentary actuation of the foot switch 171 or to operate through a cycle involving any number of wraps over six by depressing the foot switch and holding it depressed for the desired number, noting that on release of the foot switch, the next time flag 179 passes sensor switch 177, the final wrap is initiated.

Prior to starting any wraPPing operation, the ring is in its home position illustrated in FIG. 1 wherein the roll of film 23 is approximately at the one o'clock position. The film extends from the roll 23 over the guide roller 35, under the wrap roller 36 and around the tensioning roller 37 to the grippers 75. The camshaft 105 and the cams 103 and 151 are in their home position, the grippers are in their inner (extended) position and closed, gripping the film at the opposite edges thereof at its leading end 3L to enable wrapping to proceed (see FIGS. 1 and 3). The spacer fingers 97 are back in their retracted position (see FIGS. 13 and 14), and the knife 139 and pad 149 are down in retracted position.

Assuming that the selection switch 191 has been set for a 2-wrap operation (the minimum number of wraps), the work W to be enwrapped is placed on the table 1 within the ring 27 extending across the slot 5 in the table with that region of the work which is to be wrapped in the plane P. A suitable adjustable guide (not shown) may be provided for facilitating placement of the work in the wrapping position. With the work in place, the foot switch 171 is depressed. This results in operation of the stepper motor 33 to rotate the ring 27 around the work in clockwise direction as viewed in FIG. 1 (as viewed from the front of the apparatus). As the ring rotates, it carries the roll of film 23, the guide roller 35, the wrap roller 36 and the tension roller 37 around the work, and the film is accordingly wrapped around the work, traveling from the roll 23 over the guide roller 35 and thence under the wrap roller 36 and around the tensioning roller 37, extending from the latter to the work. The grippers 75 of the two units 41A and 41B hold the leading end of the film fixed underneath the work to enable the wrapping of the film around the work. The film is wrapped around the work under tension as a result of impedance of the tension roller 37 and is stretched for tightly encircling the work.

Figure 4:
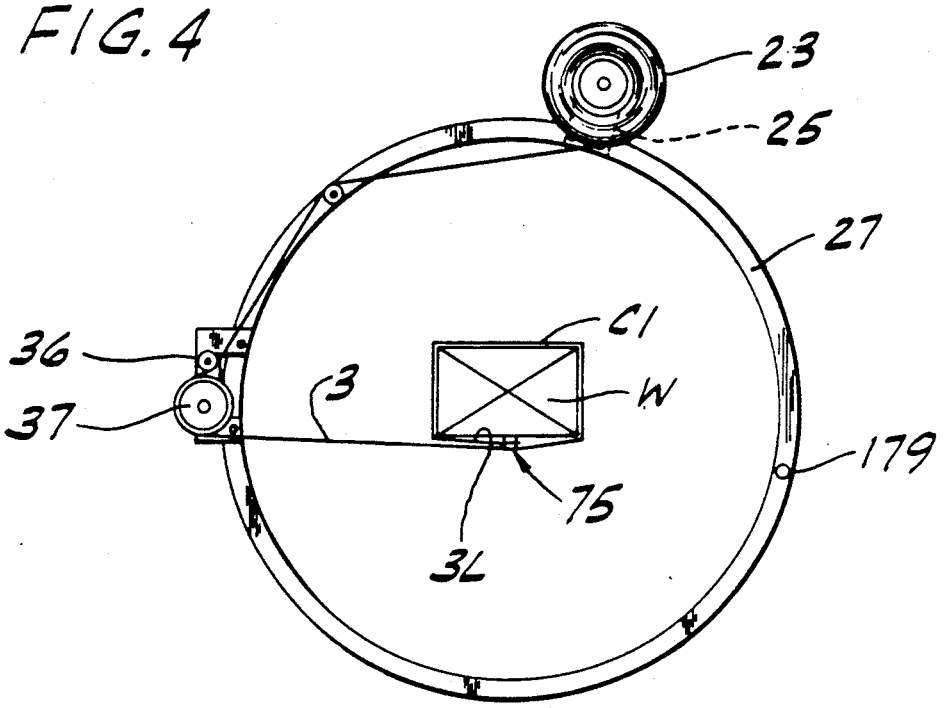
FIG. 4 is a view showing the ring rotated 360° clockwise from its FIG. 1 position and having completed a first wrap around the work being wrapped.
Figure 5:
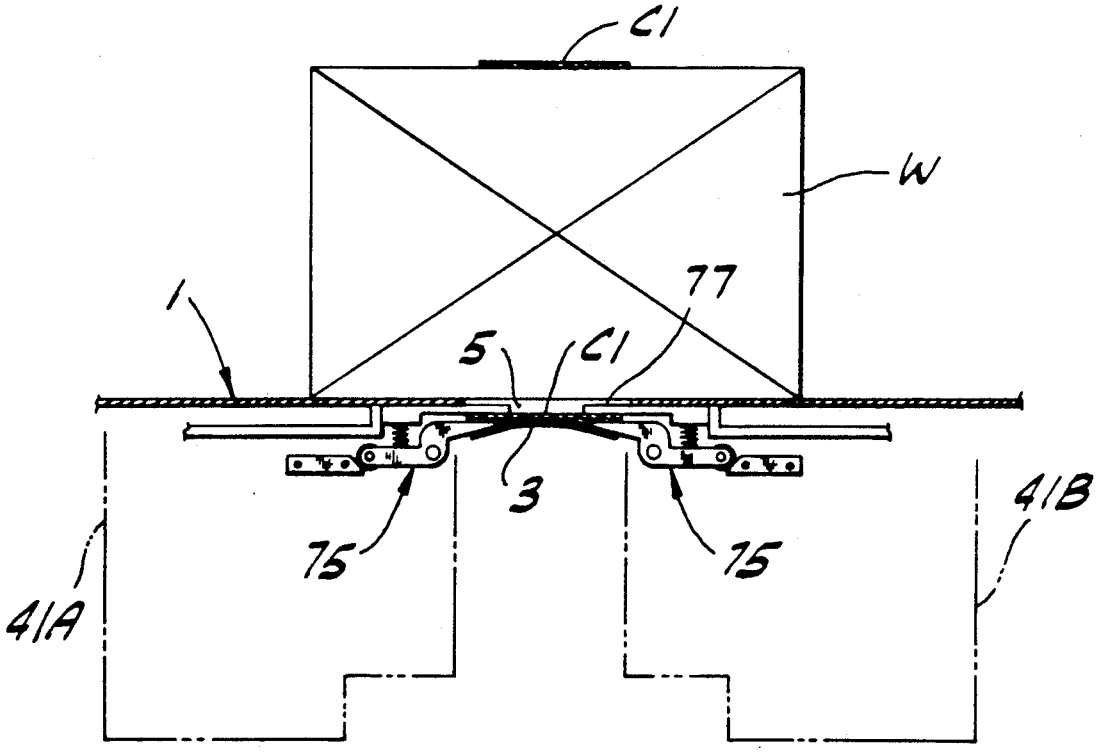
FIG. 5 is a view similar to FIG. 3 showing parts in their position when the ring has rotated to its FIG. 4 position.
Figure 4A:
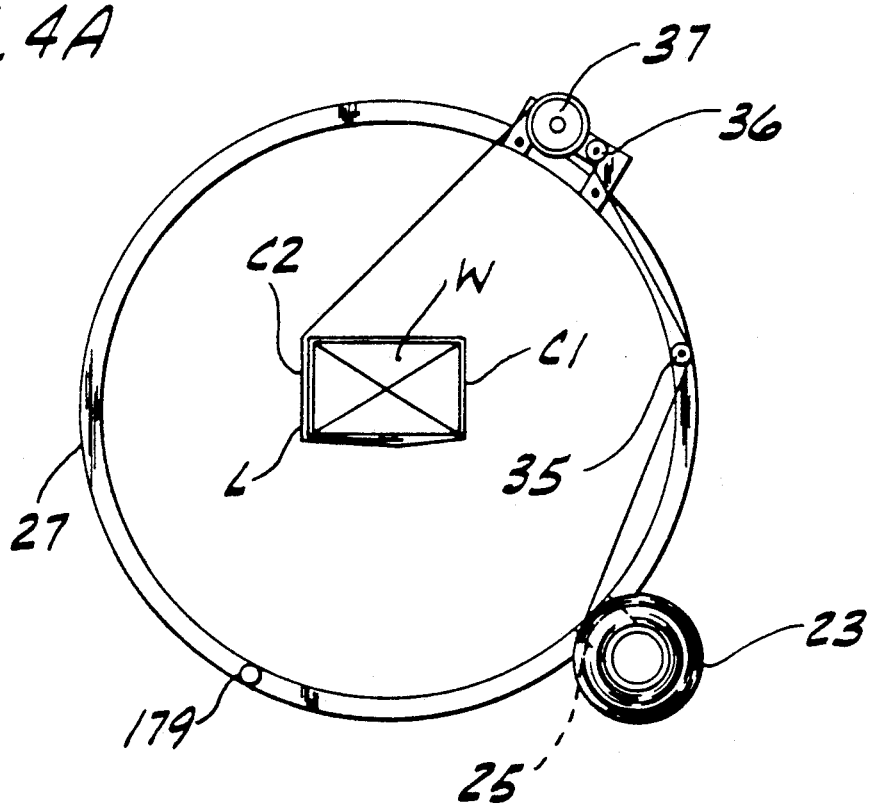
FIG. 4A is a view showing a further movement of the ring (and the roll of film) continuing the wrapping operation.

The ring 27 continues rotating after it has rotated through a full revolution and completed the wrapping of the first convolution (one wrap) C1 of the film around the work. On the continued rotation of the ring, the film comes under the grippers as shown in FIGS. 4 and 5 and then laps itself as indicated at L in FIG. 4A. This lapping results in gripping of the film by itself so that the grippers 75 may be disengaged from the film and moved out for tight wrapping of the next convolution C2. On a signal from the switch 177 sensing the passage of the flag 179 on the ring, the controller 173 functions to start each of motors 117 to drive the camshaft 105 of each unit 41A, 41B through its initial 90° of rotation from its home position. Each motor 117 remains energized until the respective proximity switch 187 senses 90° of rotation of 173 to cut off each motor 117 and stop each camshaft 105 and cams 103 and 151 in the 90° position. As the cam 103 of each unit rotates through the initial 90°, it swings the respective lever 107 to move the respective gripper 75 out, and as each gripper so retracts, it is opened for release from the edge of the film by reason of the cam follower 89 on the swingable jaw 81 of the gripper riding up on the respective fixed cam 91 (see FIG. 18). Outward movement of the grippers to their retracted position occurs after the aforesaid lapping, clearing the way for continuing the wrapping.

After a time delay established by the controller 173, allowing the roll of film and the tension roller 37 to reach the home position, and the reach of film extending from roller 37 to the work to reach the position level with the table 1, the controller acts to re-start the motor 117 of each of the units 41A and 41B for driving the camshaft 105 of each unit through the second 90° of rotation, thereby to rotate the cams 103 and 105 through the second 90° of their rotation. Each motor 117 remains in operation until the respective proximity switch 187 senses the completion of the second 90° of rotation and transmits a signal to the controller 173 to cut off each motor 117 and stop each camshaft 105 and cams 103 and 151 in the 180° position. As the cam 103 of each unit rotates through the second 90°, it swings the respective lever 121 to drive the respective slide plate 95 and the respective set of spacer fingers 97 to their extended position (see FIGS. 8–10, 16, 17 and 19) reaching in past the vertical planes of the side edges of the film underneath the preceding wrap of film for spacing the second (and last) convolution or wrap C2 of the film which is to follow away from the preceding convolution or wrap to enable the grippers 75 to move in to their inner (extended) position and to open.

Figure 6:
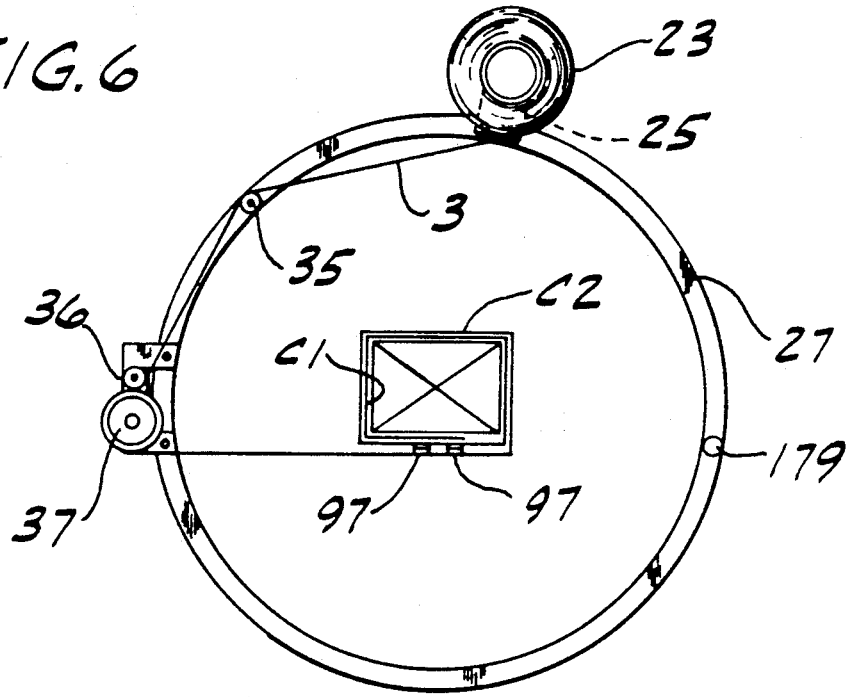
FIG. 6 is a view similar to FIGS. 4 and 4A showing the ring rotated about 720° from its FIG. 1 position and having completed a second wrap.
Figure 7:
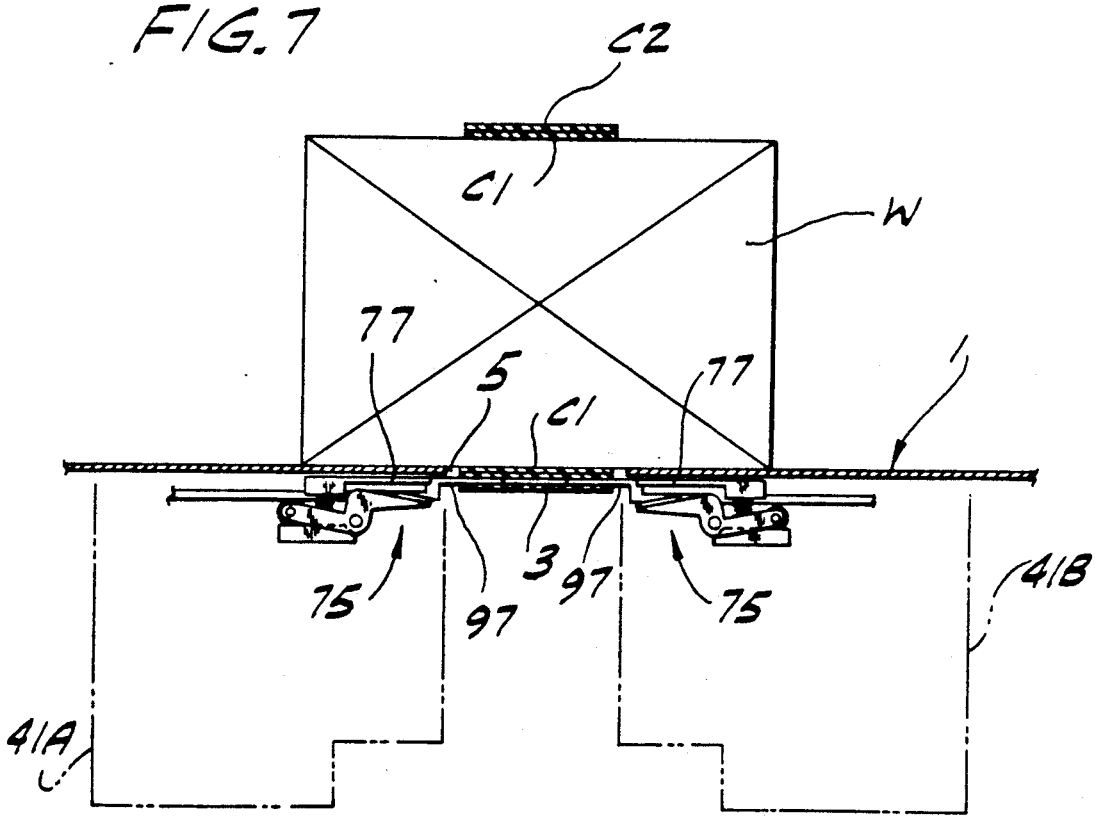
FIG. 7 is a view similar to FIGS. 3 and 5 showing the grippers retracted and certain spacer fingers extended to space the last wrap from the underlying portion of the film.
Figure 8:
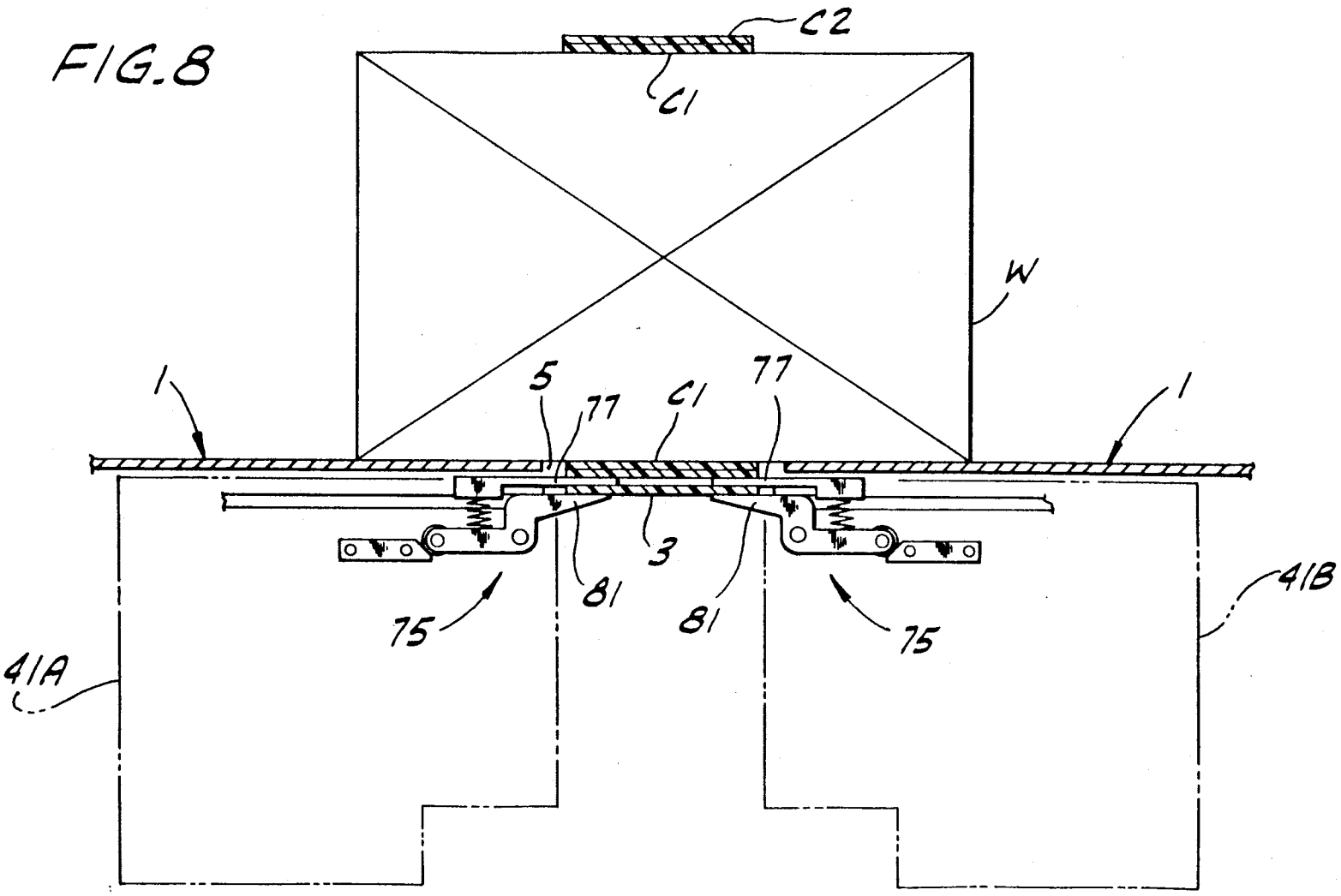
FIG. 8 is an enlargement of FIG. 7 showing the grippers extended for gripping the film as enabled by the spacing.
Figure 16:
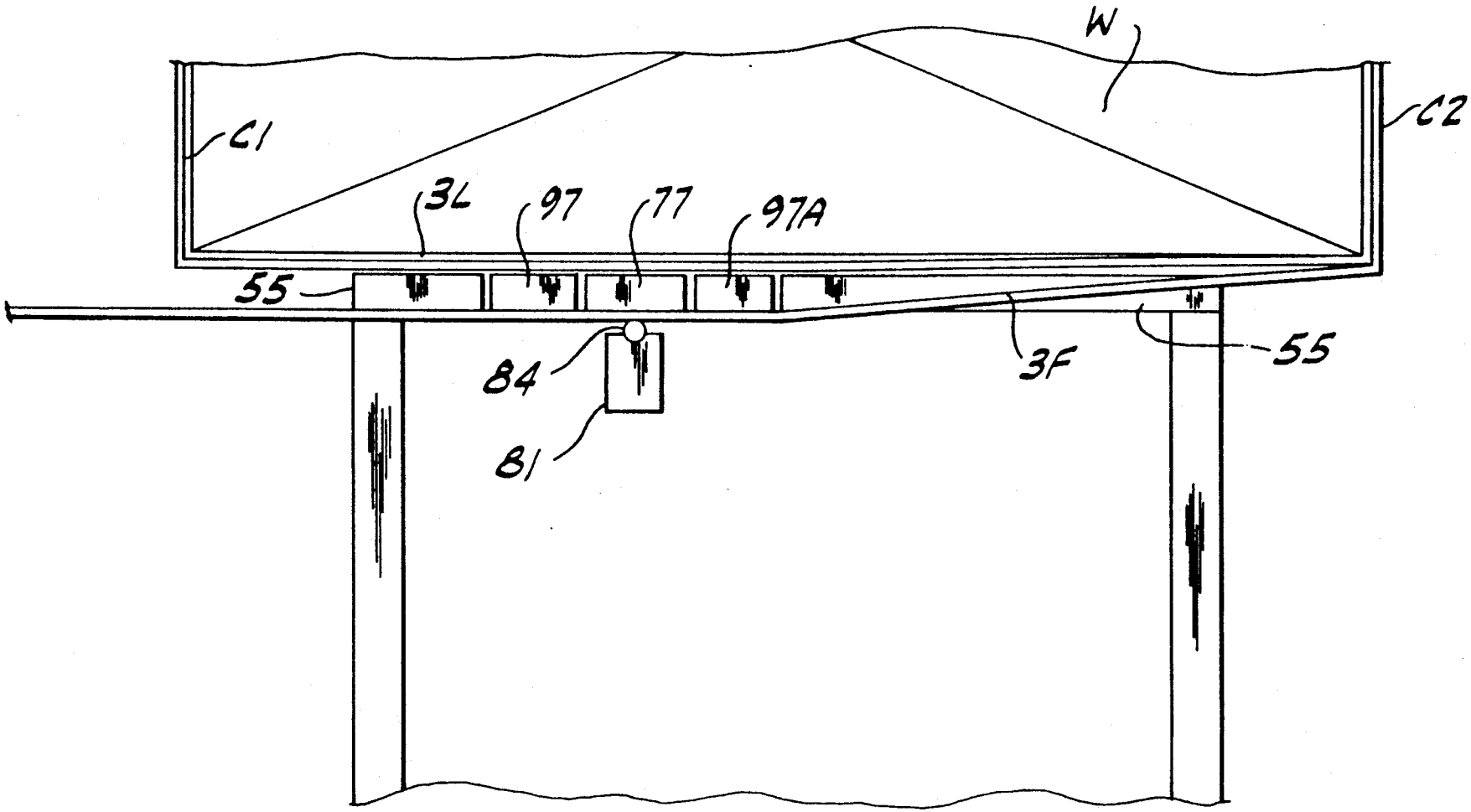
FIG. 16 is a view in section generally on line 16—16 of FIG. 10 and on a larger scale than FIG. 16 showing how the last convolution is spaced from the underlying portion of the film and gripped, and showing the knife and pad in their lowered retracted position.
Figure 17:
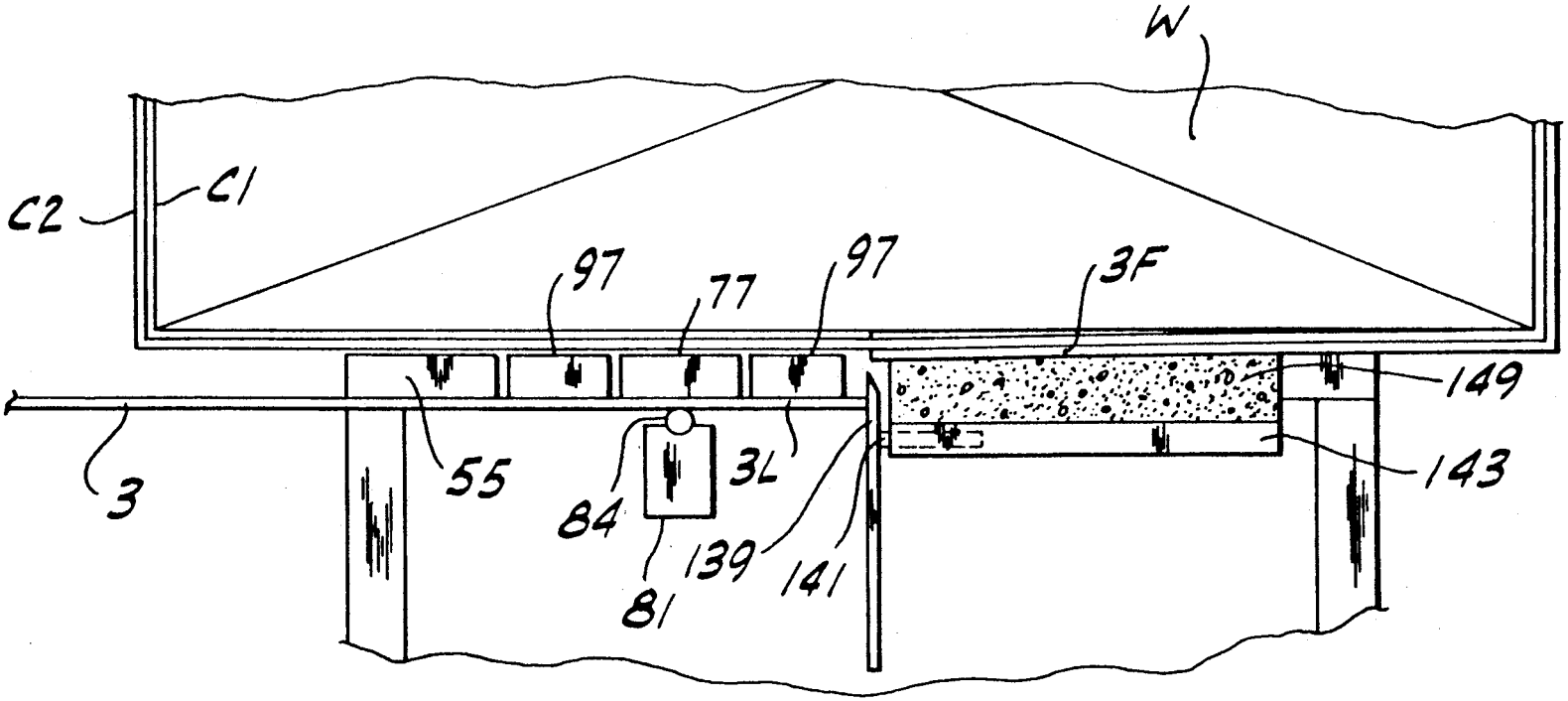
FIG. 17 is a view similar to FIG. 16 showing the knife and pad raised and the film cut by the knife providing a new leading end of the film, gripped by the grippers, and a finishing end for the last wrap pressed by the pad against the underlying portion of the film.

With the spacer fingers 97 in their extended position, the second (and last) wrap or convolution C2 is completed, this wrap engaging the bottom surfaces of the spacer fingers 97 for the spacing of the second (and last) wrap from the preceding (first) wrap, as more particularly shown in FIG. 16. With the selector switch having been set for effecting two wraps, and this setting having been transmitted to the controller 173, the latter under control of the proximity switch 177 for the ring functions to stop the ring in the home position at the conclusion of the second wrap (see FIG. 6). As the ring is coming to a stop, the motor 117 of each unit 41A, 41B is restarted and held in operation for rotating the camshaft 105 of each unit through its final 180° of rotation and back to home position. As the camshaft rotates through the final 180°; the grippers 75 are driven inward to extended (inner) position and grip the last convolution of the film underneath the work at opposite sides of the film (see FIGS. 8 and 16). With the (second) last convolution C2 spaced by the fingers 97 from the preceding convolution, the way is clear for the upper gripper jaws 77 to enter between the last convolution and the preceding convolution and for the lower gripper jaws 81 to be closed up on the film by the gripper springs 87 as the followers 89 at the tail ends of the lower jaws ride down off the cams 91. The cam 155 then acts to swing the lever 145 carrying the hot knife 139 and the pad 149 up for engagement of the pad with the last convolution C2 to press it up against the preceding convolution and for cutting of the film between the pad and the adjacent finger 97 (see FIG. 17). The knife and pad then swing back down, leaving the finishing end 3F for the completed wrapping secured to the underlying convolution of the film by reason of the cling of the film, and leaving a new leading end 3L of the film from the roll of film 23, gripped by the grippers 75, for starting the next wrapping operation. After a short pause, the spacer fingers 97 are retracted, and motors 117 stop with the cams in the home position. Thus, with the ring 27 in the home position, the apparatus is ready for the next cycle.

For wrapping the work with two to six wraps, the selection switch 191 is set for the number desired, and the operation is similar to that described above for two wraps, noting that the spacer fingers 97 are extended after the start of wrapping the last convolution (the third, fourth, fifth or sixth as the case may be, as results from setting of the controller 173 by the selection switch 191. For wrapping with N wraps more than six, the selection switch 191 is so set, and the operation is again similar, noting that the foot switch 171 is appropriately held on and released for completing the wrapping and here again the spacer fingers are extended after the start of wrapping the last (Nth) convolution.

In view of the above, it will be seen that the several objects of the invention are achieved and other advantageous results attained.

As various changes could be made in the above methods and apparatus without departing from the scope of the invention, it is intended that all matter contained in the above description or shown in the accompanying drawings shall be interpreted as illustrative and not in a limiting sense.

What is claimed is:

1. The method of wrapping a strip of wrapping material around work to be enwrapped comprising:

holding the work in position for having the strip wrapped around it in a predetermined plane;

supplying strip from a roll thereof with the roll movable around the work for wrapping it;

gripping the strip at opposite sides thereof adjacent its leading end for starting the wrapping of the work by a pair of grippers which are movable in and out transversely with respect to the strip between an inner position for gripping the strip at opposite sides thereof in a predetermined plane, and an outer retracted position spaced a distance greater than the width of the strip;

moving the roll around the work for wrapping a plurality of convolutions of the strip around the work;

opening the grippers for disengagement from the strip and moving them to their outer position after the first convolution has been wrapped around the work and the strip has lapped itself for gripping itself to the work for continuing the wrapping with the grippers disengaged from the work and moved to their outer position;

holding the terminal portion of the last convolution of the strip spaced away from the underlying portion of the strip with said terminal portion having a flat reach in said predetermined gripper plane to enable the opened grippers to move in to their inner position for gripping said flat reach of said terminal portion in said plane;

moving the opened grippers in to their inner position and closing them to grip the strip at opposite sides thereof;

cutting the strip to provide a finishing end for the wrapping being completed and a new leading end of the strip, gripped by the grippers, for starting the next wrapping operation; and securing the finishing end to the underlying portion of the strip to complete the wrap.

2. The method of claim 1 wherein the terminal portion of the last convolution is held away from the underlying portion of the strip material to enable the inward movement of the grippers by moving spacer means transversely with respect to the strip inwardly from a position clear of the strip to a position between the next to last convolution and the last convolution for engagement of the terminal portion of the last convolution with said spacer means.

3. The method of claim 2 wherein two spacer means are moved inwardly toward one another from opposite sides of the strip.

4. The method of claim 3 wherein the cutting is effected by moving a knife into cutting engagement with the spaced-away portion of the last convolution of the strip.

5. The method of claim 4 wherein each spacer means spaces the strip away from the underlying strip on opposite sides of the respective grippers.

6. The method of claim 5 wherein the cutting is effected by moving the knife into cutting engagement with the spaced-away portion of the strip adjacent one side of the spacer means such as to provide the finishing end for the wrapping being completed and the new leading end of the strip, gripped by the grippers.

7. The method of claim 6 wherein the knife is heated.

8. The method of claim 1 wherein the wrapping material is a strip of flexible stretchable plastic film, said film being wrapped under tension and thereby stretched as it is wrapped.

9. The method of claim 7 wherein the film is a cling film and wherein the finishing end thereof is secured to the underlying portion of the film by causing it to cling to the underlying portion of the film.

10. The method of claim 9 wherein two spacer means are moved inwardly toward one another from opposite sides of the film, wherein each spacer means spaces the film away from the underlying film on opposite sides of the respective gripper, wherein the cutting is effected by moving the knife into cutting engagement with the spaced-away portion of the strip adjacent one side of the spacer means such as to provide the finishing end for the wrapping being completed and the new leading end of the film, gripped by the grippers, and wherein the finishing end is pressed against the underlying portion of the film for causing it to cling thereto.

11. Apparatus for wrapping a strip of wrapping material around work to be enwrapped comprising:

means for holding the work in position for having the strip around the work for wrapping it;

means for holding a roll of the strip for movement of the roll around the work for wrapping it;

a pair of grippers for gripping the strip at opposite sides thereof adjacent its leading end in a predetermined plane for starting the wrapping of the work;

means mounting the grippers for movement in an out transversely with respect to the strip between an inner position for gripping the strip at opposite sides thereof and an outer retracted position spaced a distance greater than the width of the strip;

said grippers being constructed and arranged for closing to grip the strip and for opening to release the strip;

means for moving said roll holding means around the work for wrapping a plurality of convolutions of the strip around the work;

means for controlling the grippers to move them inwardly while open to their inner position and closing them to grip the strip at opposite sides thereof adjacent its leading end, to maintain their grip on the film while the first convolution of the strip is being wrapped around the work and until it has lapped itself for gripping itself to the work, then opening the grippers and moving them out to their outer retracted position;

means movable into position before completion of the wrapping of the last convolution of the strip for holding the terminal portion of the last convolution away from the underlying portion of the strip with said terminal portion having a flat reach in said predetermined gripper plane to enable the inward movement of the grippers for gripping said flat reach of said terminal portion in said plane at opposite sides of the strip;

means for cutting the strip to provide a finishing end for the wrapping being completed and a new leading end of the strip, gripped by the grippers, for starting the next wrapping operation; and p1 means for securing the finishing end of the wrapping to the underlying portion of the strip to complete the wrap.

12. Apparatus as set forth in claim 11 wherein said holding means comprises spacer means movable transversely with respect to the strip inwardly from a position clear of the strip to a position between the next to last convolution and the last convolution for engagement of the terminal portion of the last convolution with said spacer means.

13. Apparatus as set forth in claim 12 comprising a pair of spacer means movable inwardly toward one another from opposite sides of the strip.

14. Apparatus as set forth in claim 13 wherein the cutting means comprises a knife movable into cutting engagement with the spaced-away portion of the last convolution of the strip.

15. Apparatus as set forth in claim 14 wherein each gripper comprises a pair of jaws one of which is movable toward and away from the other for opening and closing thereof, and means for effecting closing thereof on inward movement thereof and opening thereof on outward movement thereof.

16. Apparatus as set forth in claim 15 wherein each spacer means comprises a pair of spacer fingers at opposite sides of the respective gripper

17. Apparatus as set forth in claim 16 wherein the means for cutting the strip compresses a knife movable from a retracted position into cutting engagement with the spaced-away portion of the strip adjacent one side of the spacer means such as to provide the finishing end for the wrapping being completed and the new leading end of the strip, gripped by the grippers.

18. Apparatus as set forth in claim 17 for wrapping with a strip of flexible stretchable plastic cling film having means for wrapping the film under tension for thereby stretching it as it is wrapped.

19. Apparatus as set forth in claim 18 wherein the means for securing the finishing end of the film to the underlying portion of the film comprises means for pressing it to the underlying portion of the film to cause it to cling thereto.

20. Apparatus as set forth in claim 15 having cam-operated means for effecting the movement of the grippers, the spacer means and the knife.

* * * * *